United States Patent [19]

Broyhill et al.

[11] 4,210,407

[45] Jul. 1, 1980

[54] LITTER CONTROL ASSEMBLY

[75] Inventors: Roy F. Broyhill; James R. Parsons, both of Dakota City, Nebr.

[73] Assignee: The Broyhill Manufacturing Company, Wayne, Nebr.

[21] Appl. No.: 913,515

[22] Filed: Jun. 7, 1978

[51] Int. Cl.[2] ..... B65F 3/02

[52] U.S. Cl. ..... 414/407; 414/501

[58] Field of Search ..... 414/501, 404, 406, 407, 414/408; 220/229; 150/9; 229/62.5; 296/100, 101, 136

[56] References Cited

U.S. PATENT DOCUMENTS

| | | | |
|---|---|---|---|
| 2,528,332 | 10/1950 | Berquist | 229/62.5 X |
| 3,116,927 | 1/1964 | Kuhlman | 220/229 X |
| 3,130,845 | 4/1964 | French et al. | 414/406 |
| 4,082,347 | 4/1978 | Petretti | 296/100 X |
| 4,113,120 | 9/1978 | Pickrell | 414/406 |

*Primary Examiner*—Stephen G. Kunin
*Assistant Examiner*—Terrance L. Siemens
*Attorney, Agent, or Firm*—Zarley, McKee, Thomte, Voorhees & Sease

[57] ABSTRACT

A litter control assembly for use with a refuse collection vehicle including a drive vehicle having a collection box removably mounted thereon. The litter control assembly comprises a pair of upstanding screen members which extend upwardly from opposite sides of the collection opening in the upper forward end of the refuse collection box. A flexible sheet member is secured to the refuse collection box rearwardly of the collection opening and is secured to the upper rearward ends of the screens to prevent litter from blowing rearwardly therebetween. A crusher panel is pivotally mounted on the vehicle and is positioned between the forward ends of the screen members. Elongated flexible whiskers are secured to the upper ends of the screen members and extend inwardly over the collection opening. A plurality of elongated flexible whiskers are also secured to the upper end of the crusher panel and extend inwardly over the forward end of the opening formed in the collection box. The whiskers substantially cover the collection opening in the collection box to prevent litter from blowing out of the box during the collection or transfer of the refuse. The flexible characteristics of the whiskers permit a refuse container to be lowered downwardly therethrough during the collection of refuse.

7 Claims, 7 Drawing Figures

LITTER CONTROL ASSEMBLY

BACKGROUND OF THE INVENTION

This invention relates to a litter control assembly and more particularly to a litter control assembly adapted for use on a refuse collection vehicle.

A problem generally present in the refuse collection process is the prevention of blowing trash or litter.

Therefore, it is a principal object of the invention to provide a litter control assembly for use with a refuse collection vehicle or system which prevents litter or trash from blowing from the refuse collection box.

A further object of the invention is to provide a litter control assembly which not only maintains lightweight refuse in place in a collection box but also permits an individual refuse container to be lowered downwardly therethrough without interference with the collection process.

A still further object of the invention is to provide a litter control assembly which may be mounted on a refuse collection system without extensive modification thereof.

A still further object of the invention is to provide a litter control assembly which is economical of manufacture and durable in use.

These and other objects will be apparent to those skilled in the art.

SUMMARY OF THE INVENTION

A litter control assembly is described which is ideally suited for use with a refuse collection system comprising a drive vehicle having a collection box removably mounted thereon. The collection box is provided with a collection opening at the upper forward end thereof. Litter normally blows from the refuse collection opening during the deposit of refuse in the collection box and during the transport of the collection box from one location to another. The present invention comprises a litter control assembly which is mounted on the upper ends of compactor arms. The assembly comprises a pair of wind screens which are positioned on opposite sides of the collection opening and which have a plurality of nylon whiskers secured to the upper ends thereof which extend inwardly over the collection opening. A crusher panel is positioned between the forward ends of the wind screens and also has a plurality of the nylon whiskers mounted thereon which extend over the forward end of the collection opening. A flexible sheet member extends from the collection box to the upper rearward ends of the wind screens to close the rearward end of the assembly. The nylon whiskers permit the refuse containers to be lowered downwardly therethrough for dumping the refuse into the collection box. The nylon whiskers, flexible sheet member and wind screens above and around the collection opening in the collection box prevent lightweight litter or refuse from blowing from the box.

DESCRIPTION OF THE PREFERRED EMBODIMENT

Figure 1:
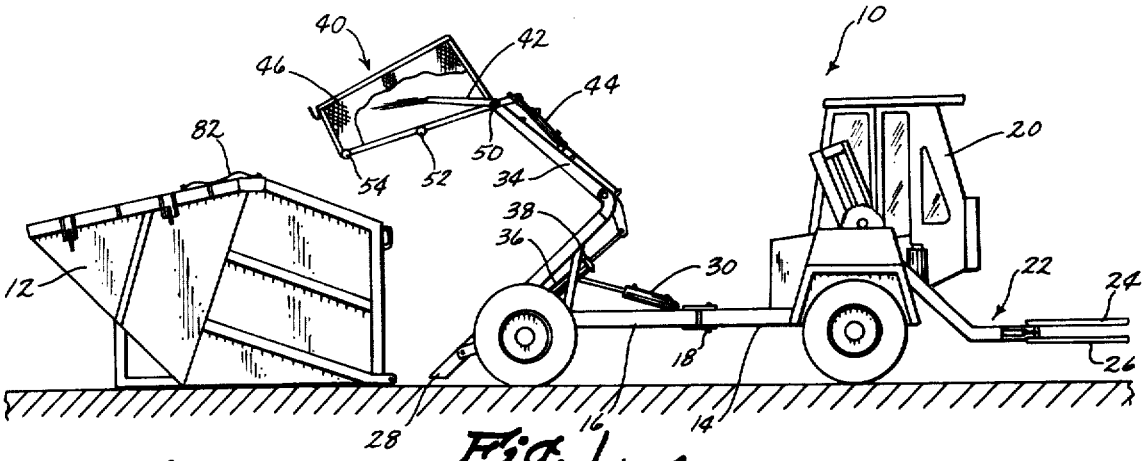
FIG. 1 is a side view illustrating a refuse collection vehicle having the litter control assembly of this invention mounted thereon with a removable collection box being shown in a removed position.

With respect to FIG. 1, the numeral 10 refers generally to a refuse collection vehicle of the type manufactured by The Broyhill Mfg. Co. of Wayne, Neb. The numeral 12 refers generally to a refuse collection box which is adapted to be mounted on the vehicle 10 during the collection of refuse.

Although the particular control assembly being described herein is preferably mounted on a refuse collection vehicle such as illustrated in the drawings, it should be understood that the litter control assembly will work equally as well on those collection vehicles having refuse collection boxes permanently mounted thereon. Additionally, the litter control assembly described herein may also be used on stationary refuse collection boxes which are not mounted on vehicles at all. In other words, the litter control assembly of this invention can be used whenever transfer of refuse is undertaken from one container (box, etc.) to another.

Generally speaking, the vehicle 10 includes forward and rearward frames 14 and 16 articulated at 18. A cab 20 is mounted on forward frame 14 and encloses the operator's seat as well as the necessary controls for operating the vehicle. Forward frame 14 is provided with a pair of drive wheels as is the rear frame.

Lift arm assembly 22 is mounted on the forward frame 14 and has a pair of grip arms 24 and 26 which are adapted to embrace a refuse container 27, when the container is on the ground, and to move the same upwardly to permit the refuse to be dumped into the box 12 as will be described in more detail hereinafter.

Figure 2:
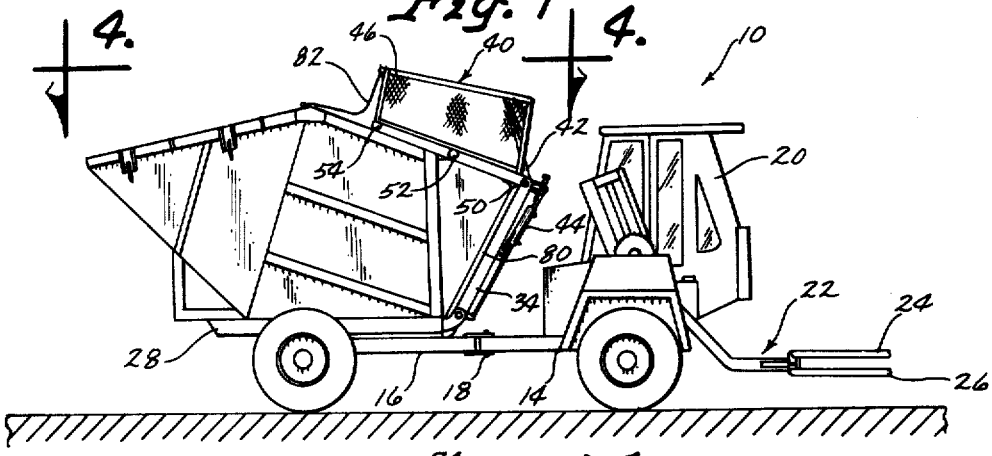
FIG. 2 is a side view illustrating the refuse collection box mounted on the vehicle with the litter control assembly in place.
Figure 3:
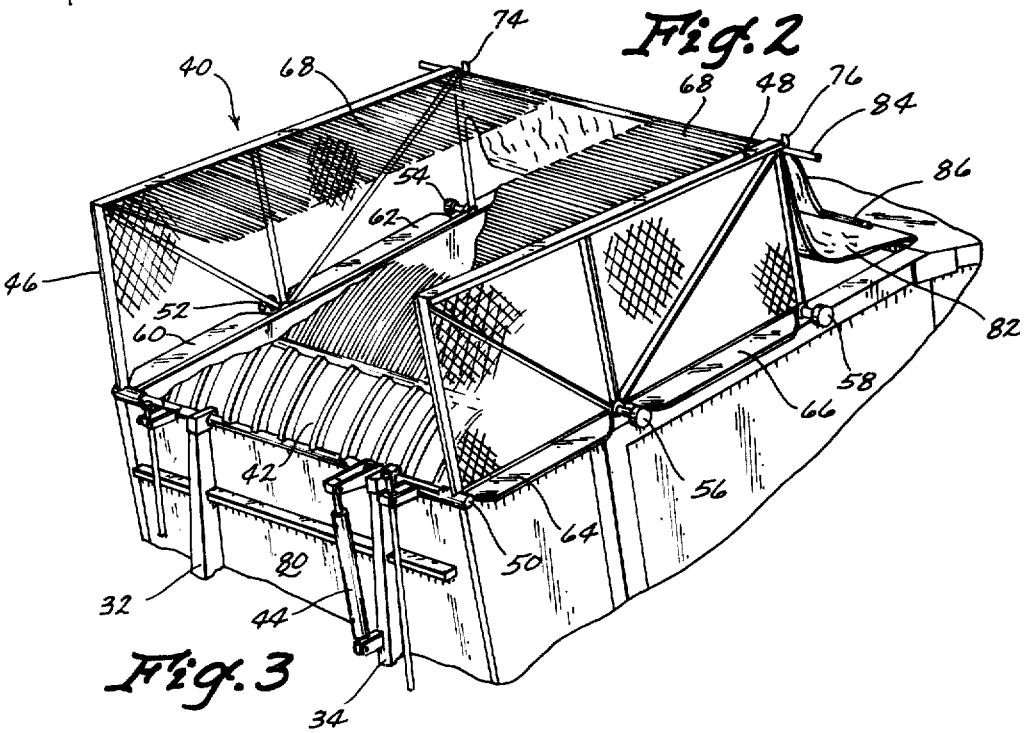
FIG. 3 is a perspective view of the litter control assembly of this invention mounted on the collection box.

Tilt frame 28 is pivotally mounted on rear frame 16 and is movable from the position of FIG. 1 to the position of FIG. 2 by means of tilt cylinder 30. Compactor arms 32 and 34 are pivotally mounted to the forward ends of the tilt frame members by means of compactor cylinders 36 and 38.

Vehicle 10 is a four-wheel vehicle with a water cooled diesel engine and hydrostatic drive for driving the front and and rear wheels. The vehicle is steered by means of center articulated steering. All principal functions, including steering, power train, grip and lift, compaction, crusher panel, and tilt for box load and offload are hydraulically powered and controlled from the cab. Reference is made to patent applications, Ser. Nos. 710,654, filed Aug. 2, 1976, now abandoned and 770,398, filed Feb. 22, 1977, now U.S. Pat. No. 4,113,120 for a more complete description of the general type of vehicle 10.

The numeral 40 refers to the litter control assembly of this invention which is ideally suited for use with the vehicle 10 and collection box 12 although the litter control assembly may be used with other types of refuse collection vehicles and collection boxes as described. It is the primary purpose of the litter control assembly 40 to prevent litter from blowing from the interior of the refuse collection box while the box is on the vehicle while yet permitting the convenient deposit of refuse into the container during the collection process.

Figure 5:
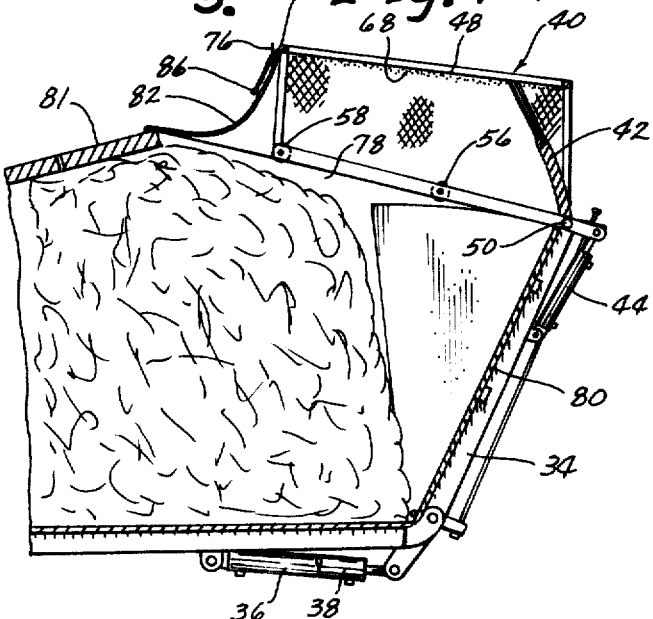
FIG. 5 is a sectional view of the litter control assembly mounted on the collection box as seen on lines 5—5 of FIG. 4.
Figure 6:
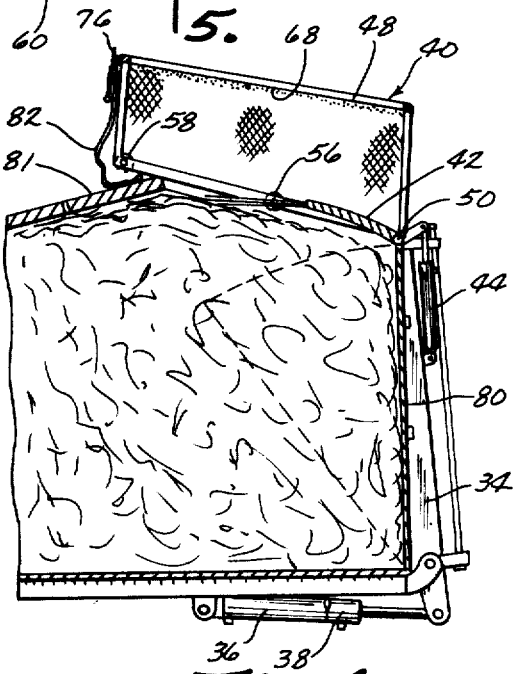
FIG. 6 is a view similar to FIG. 5 except that the crusher panel has been pivoted towards the refuse collection box opening.

Litter control assembly 40 includes a crusher panel 42 which is pivotally mounted on the upper ends of the compactor arms 32 and 34. Crusher panel 42 is pivotally moved relative to the compactor arms by crusher panel cylinder 44. Crusher panel 42 is pivotally movable, by the cylinder 44, from the positions of FIGS. 5 and 6 as will be described in more detail hereinafter. Upstanding wind screens 46 and 48 are secured at their lower forward ends to shaft 50. Screen 46 is provided with rollers 52 and 54 at the lower end thereof while screen 48 is provided with rollers 56 and 58 at the lower end thereof. Flexible members 60 and 62 are secured to the lower end of screen 46 forwardly and rearwardly of the roller 52 respectively. Likewise, screen 48 is provided with flexible members 64 and 66 which are identical to the flexible members 60 and 62.

A plurality of elongated and flexible members or whiskers 68 are secured to the upper end of screen 46 and extend inwardly therefrom as illustrated in the drawings. Likewise, a plurality of elongated flexible members or whiskers 68 are secured to the upper end of screen 48 and extend inwardly therefrom. It can also be seen that a plurality of elongated flexible members or whiskers 72 are secured to the upper end of crusher panel 42 and extend therefrom as will be described in more detail hereinafter. Screens 46 and 48 are provided with brackets 74 and 76 at the upper rearward ends thereof respectively.

Collection box 12 is provided with a collection opening 78 at the upper forward end thereof. Box 12 is also provided with a compactor member 80 at the forward portion thereof which is movable by the compactor arms 32 and 34 to compact the refuse within the box. Box 12 also includes lids 81 at its upper rearward end which are opened when it is desired to dump the refuse from the box 10. Flexible sheet member 82 is secured to the upper portion of the box 12 rearwardly of the opening 78 and has a sufficient length so as to cover the opening 12 for closing the box when not in active use. Spaced-apart pipes 84 and 86 are secured to the flexible sheet member. When the sheet member 82 is covering the opening 78, pipe 86 would be positioned forwardly of the opening 78 to maintain the sheet member in place. Pipe 84 is adapted to be received by the brackets 74 and 76 as will be described in more detail hereinafter.

FIG. 1 illustrates the collection box 12 removed from the vehicle 10. As previously stated, the flexible sheet member 82 would normally close the collection opening 78 during periods that the box is not in active use. When it is desired to load the box 12 on the vehicle 10, the flexible sheet member 82 would be moved rearwardly with respect to the collection opening 78. The vehicle 10 is aligned with the box 12 and tilt frame 28 is pivotally moved upwardly to the position of FIG. 1. The vehicle 10 is then backed adjacent the forward end of the box 12. A box loading chain, not shown, which is secured to crusher panel 42 is then connected to the box 12. Compactor arms 32 and 34 are then pivotally moved with respect to the tilt frame 28 with such movement causing the box 12 to be pulled onto the tilt frame 28. Tilt frame 28 is then pivotally moved to the horizontal position. Compactor arms 32 and 34 are then pivotally moved rearwardly relative to the box 12. The compactor arms 32 and 34 are then secured to the compactor 80. The connection of the compactor to the compactor arms 32 and 34 automatically frees the compactor 80 from its locked position on the box 12 so that the compactor may pivotally move relative to the sidewalls of the box.

It is recommended that pipe 84 be mounted in the brackets 74 and 76 while the box 12 is still on the ground with the litter control assembly positioned over the box opening. As the box is loaded onto the tilt frame, the rollers 54 and 58 on screens 46 and 48 engage the upper surface of the box on opposite sides of the collection opening 78. When the box 12 is in position on the vehicle 10, the rollers at the lower ends of the screens 46 and 48 do engage the upper portions of the sidewalls of the box 12 on opposite sides of the collection opening 78. The flexible members 60, 62, 64 and 68 also engage the upper portions of the sidewalls of the box 12 on opposite sides of the collection opening 78 to effectively seal the space between the screens 46 and 48 and the box.

It can be seen that the litter control assembly 40 is positioned over the collection opening 78 when the box 12 is mounted on the vehicle. When the litter control assembly 40 is so mounted, the flexible sheet member 82 extends between the rearward ends of the screens 46 and 48 to prevent litter from passing outwardly rearwardly through the screens 46 and 48.

Figure 7:
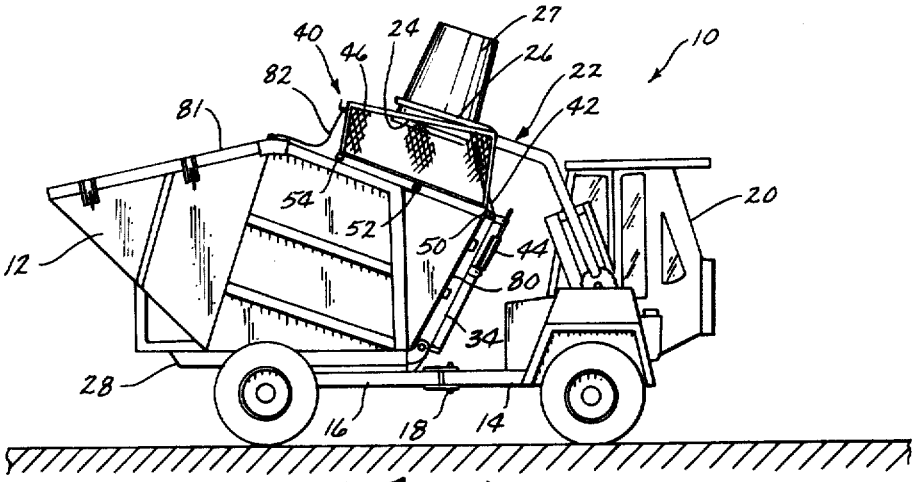
FIG. 7 is a side view illustrating a refuse can being dumped into the refuse collection box through the litter control assembly.
Figure 4:
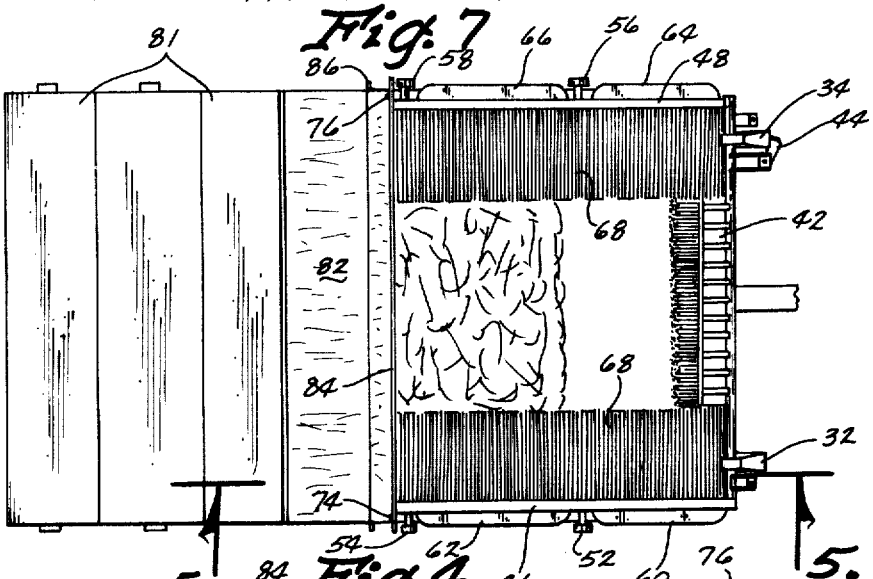
FIG. 4 is a top view of the litter control assembly mounted on the refuse collection box.

When it is desired to deposit refuse within the box 12, the lift arm assembly 22 would be manuevered to grasp the refuse container 27. The refuse container 27 is moved upwardly and rearwardly by the lift arm assembly 42 with the container 27 being moved downwardly through the whiskers 68, 70 and 72 on the litter control assembly 40. When the refuse container 27 is positioned in the inverted condition as illustrated in FIG. 7, the refuse is dumped from the container below the whiskers 68, 70 and 72 which prevents the litter or refuse from blowing out of the collection box 12. When the refuse has been dumped from the container 27, the lift arm assembly 22 is actuated to lower the container back onto the ground. When sufficient refuse has been deposited in box 12, the compactor 80 is pivotally moved rearwardly while the crusher panel 42 is pivotally moved downwardly to compact and crush the refuse in the box 12. The vehicle is then moved to a new location to collect additional refuse from additional refuse containers. The whiskers 68, 70 and 72 and the flexible sheet member 82 prevent the litter from blowing out of the box 12 as the vehicle is moved from one location to another. The whiskers and the screens 46 and 48 not only physically prevent the litter from blowing out of the box 12 but also alter the wind currents passing over the collection opening 78 which also tends to maintain the litter within the box.

Thus it can be seen that a novel litter control assembly has been provided which is ideally suited for use with a refuse collection box which permits refuse to be deposited into the box in a convenient manner while preventing the refuse from blowing from the box during collection or transportation of the refuse. Thus it can be seen that the litter control assembly of this invention accomplishes at least all of its stated objectives.

We claim:

1. In combination, a wheeled refuse collection vehicle having a refuse collection box mounted thereon, said box having an opening formed therein to permit collected refuse to be placed in the interior of said box, and a litter control assembly mounted on said vehicle adjacent said box opening, said litter control assembly comprising means for permitting refuse to be passed therethrough during the collection thereof and for maintaining the refuse within said box, said box opening having rearward and forward ends and opposite sides and wherein said litter control assembly comprises first and second upstanding members positioned at the opposite sides of said box opening, a panel means positioned between said first and second upstanding members at the forward end of said box opening, elongated flexible members secured to said first and second upstanding members and said panel means, said flexible members extending at least partially over said box opening, and a flexible sheet member secured to said box rearwardly of said box opening and secured to said upstanding members for closing the rearward end of said litter control assembly.

2. In combination, a wheeled refuse collection vehicle having a refuse collection box mounted thereon, said box having an opening formed therein to permit collected refuse to be placed in the interior of said box, and a litter control assembly mounted on said vehicle adjacent said box opening, said litter control assembly comprising means for permitting refuse to be passed therethrough during the collection thereof and for maintaining the refuse within said box, said litter control assembly includes an upstanding windscreen means extending at least partially around said box opening, said litter control assembly comprising a plurality of elongated and flexible members partially extending over said box opening which physically maintain the refuse within the box and which alter the wind currents passing over said box opening to aid in maintaining the refuse within the box.

3. The combination of claim 2 wherein said litter control assembly is removably mounted on said box.

4. The combination of claim 2 wherein said collection box is removably mounted on said vehicle, said litter control assembly being mounted on said vehicle and being movable by said vehicle from an inoperative position to a position over said box opening when said box is mounted on said vehicle.

5. The combination of claim 2 wherein said box opening has rearward and forward ends and opposite sides, said windscreen means comprising first and second upstanding members positioned at the opposite sides of said box opening, a panel means positioned between said first and second upstanding members at the forward end of said box opening, said flexible members being secured to said first and second upstanding members and said panel means.

6. The combination of claim 5 wherein said panel means comprises a pivotal crusher panel which is at least partially movable into said box opening.

7. In combination, a refuse collection box having an opening formed therein to permit refuse to be placed in the interior thereof, and a litter control assembly mounted on said box adjacent said box opening, said litter control assembly comprising means for permitting refuse to be passed therethrough during the collection thereof and for maintaining the refuse within said box, said litter control assembly comprising a plurality of elongated and flexible members partially extending over said box opening which physically maintain the refuse within the box and which alter the wind currents passing over said box opening to aid in maintaining the refuse within the box.

* * * * *